United States Patent [19]

Kovacs

[11] Patent Number: 4,737,199

[45] Date of Patent: Apr. 12, 1988

[54] MACHINABLE DUCTILE OR SEMIDUCTILE CAST IRON AND METHOD

[75] Inventor: Bela V. Kovacs, Bloomfield Hills, Mich.

[73] Assignee: Ford Motor Company, Dearborn, Mich.

[21] Appl. No.: 812,035

[22] Filed: Dec. 23, 1985

[51] Int. Cl.[4] ..... C21D 5/00

[52] U.S. Cl. ..... 148/3; 148/138; 148/139; 148/321

[58] Field of Search ..... 148/3, 138, 139, 141, 148/35

[56] References Cited

U.S. PATENT DOCUMENTS

| | | | |
|---|---|---|---|
| 3,421,886 | 1/1969 | Schelleng | 148/35 |
| 3,549,431 | 12/1970 | Castelet | 148/141 |
| 3,860,457 | 1/1975 | Vourinen et al. | 148/141 |
| 4,227,924 | 10/1980 | Subramanian et al. | 75/123 CB |

FOREIGN PATENT DOCUMENTS

| | | |
|---|---|---|
| 90654 | 10/1983 | European Pat. Off. . |
| 2853870 | 7/1980 | Fed. Rep. of Germany . |
| 152149 | 11/1980 | Japan . |
| 93854 | 6/1983 | Japan . |
| 753923 | 8/1980 | U.S.S.R. . |

OTHER PUBLICATIONS

Metals Handbook, vol. 1, 1978, ASM, pp. 7–8.

*Primary Examiner*—R. Dean

*Attorney, Agent, or Firm*—Joseph W. Malleck; Roger L. May

[57] ABSTRACT

A method is disclosed which comprises: (a) forming a ferrous alloy melt consisting essentially of by weight, 3–4% carbon, 2.0–3.0% silicon, 0.1–0.9% manganese, up to 0.02% phosphorus, up to 0.002% sulphur, up to 1% contaminants or impurities, 0–0.4% molybdenum, 0–3.0% nickel or copper, and the reminder essentially iron, the melt being subjected to a graphite modifying agent in an amount and for a period of time effective to form either ductile or semiductile iron upon solidification; (b) heat treating the solidification of said melt by austempering to form a matrix consisting substantially of high carbon austenite and ferrite and a cell boundary having unreacted low carbon austenite; (c) heating said austempered iron to a pearlite forming temperature (1200°–1300° F.) and holding (2–5 minutes) at said temperature to permit the unreacted low carbon austenite to form pearlite; and (d) cooling said heat treated iron to room temperature.

7 Claims, No Drawings

MACHINABLE DUCTILE OR SEMIDUCTILE CAST IRON AND METHOD

BACKGROUND OF THE INVENTION

1. Technical Field

This invention relates to the art of making ductile or semiductile cast iron and particularly to a method for enhancing the machinability of such irons while retaining or improving other physical characteristics.

2. Description of the Prior Art

Ductile iron, in the molten form, is that which has been subjected to graphite modifiers to stimulate the formation of spheroidal graphite in the solidified iron, and semiductile iron is that typically referred to as compacted graphite iron and utilizes basically the same chemistry as that for ductile iron, but the graphite modifiers are added in smaller amounts or for different periods of time so as to not fully effect a total conversion to spheroidal graphite. Such ductile or semiductile irons are produced by the use of commercial graphite modifiers in the form of magnesium or cerium, the latter being as additions in very small regulated amounts to the melt prior to solidification. When the magnesium or cerium content in the solidified structure is about 0.025%, nodular or spheroidal graphite usually precipitates. Flake graphite is formed at magnesium concentrations below about 0.015%. Accordingly, with magnesium or cerium concentrations in the range of 0.015–0.025% compacted graphite (otherwise sometimes referred to as vermiculite) will form semiductile iron.

Conventional ductile or semiductile irons, after heat treatment to enhance the overall physical characteristics of the irons, may contain small but detrimental quantities of martensite, or if not martensite, then unreacted retained austenite which during machining converts to martensite. The conversion to martensite during machining is detrimental to tool life and to dimensional control of the part being machined. Because of the presence of such martensite, and therefore the difficulty of machining such conventional heat treated irons, such irons are necessarily subjected to heat treatment after machining, which is cumbersome. Such machining would be carried out on the as-cast metal article; this is highly uneconomical, particularly in an automated casting and heat treatment commercial line where such articles or castings must be removed and carried to a machining station and then, when machined, recarried and reinstalled in the heat treatment automated line and back to the machining line, for finish machining.

Such conventional austempered ductile irons or semiductile irons contain generally 3.5–3.8% by weight carbon (all percentages given hereafter will be considered by weight unless indicated otherwise), 2.0–3.0% silicon, 0.2–0.9% manganese, sulphur no greater than 0.015%, phosphorus no greater than 0.06%, molybdenum in the range of 0–0.5%, nickel in the range of 0–3.0%, copper in the range of 0–3.0% as a direct substitute for nickel that would ordinarily be used. A conventional ductile iron will possess a yield strength of 36–73 ksi, typically 65 ksi, a tensile strength of 58–116 ksi, typically 80 ksi, an elongation of 2–15, and a hardness in the range generally of 140–270 BHN.

The austempering treatment, as is well known, is one in which the solidified cast iron is heated to an austenitizing temperature usually about 1600° F. or in excess thereof, and held at this temperature to obtain austenite in the matrix. This will usually require about two hours, but may be in the range of 0.5–4 hours. The austenitized iron is then quenched at a rate sufficient to drop the temperature to the range of about 450°–800° F. to avoid passing through the pearlite nose of a time, temperature, and transformation plot, and holding at such intermediate temperature until the austenite is converted to a harder microstructure such as bainite or high carbon austenite and ferrite. After such conversion, the article is dropped in temperature to ambient conditions by air cooling.

In instances where the nickel and other strengthening alloying agents are introduced to the melt, the physical characteristics have been elevated to the levels of 85–100 ksi for yield strength, 100–130 for tensile strength, 5–7% elongation, and 240–320 BHN for hardness (see U.S. application Ser. No. 647,333, filed 9/4/84, commonly assigned to the assignee of this invention). Theoretically, austempering heat treatment using the presence of 0.25–0.4 molybdenum and 0.5–3% nickel allows the iron to convert to about 65% ferrite and 35% austenite. Some of the austenite converts to martensite and makes it brittle during machining.

It would be desirable if a method could be devised by which a ductile or semiductile iron could be obtained which has yield strengths in excess of 100,000 psi, a tensile strength in excess of 150,000 psi, elongation about 5%, and hardness levels of 260–300 BHN, such cast iron being machinable after heat treatment thereby eliminating the necessity for removing such castings from an automated casting and heat treat line before the machining operation is to be carried out.

SUMMARY OF THE INVENTION

It is a primary object of this invention to provide a heat treatment for ductile or semiductile iron which eliminates or minimizes the unreacted retained austenite which would transform to martensite during machining of the iron. It is an object of this invention to provide a method by which a ductile or semiductile iron is fabricated to possess the following characteristics: (a) easily machinable after heat treatment without substantially affecting preheat treatment physical properties, (b) a yield strength in excess of 100,000 psi, (c) a tensile strength in excess of 150,000 psi, and (d) an elongation of about 5%.

The inventive method comprises: (a) forming a ferrous alloy melt consisting essentially of, by weight, 3–4% carbon, 2.0–3.0% silicon, 0.1–0.9% manganese, up to 0.02% phosphorus, up to 0.002% sulphur, up to 1% contaminants or impurities, 0–0. 4% molybdenum, 0–3.0% nickel or copper, and the remainder essentially iron, said melt being subjected to a graphite modifying agent in an amount and for a period of time effective to form either ductile or semiductile iron upon solidification; (b) heat treating the solidification of said melt by austempering to form a matrix consisting substantially of high carbon austenite and ferrite and a cell boundary having unreacted low carbon austenite; (c) heating said austempered iron to a pearlite forming temperature and holding at said temperature to permit the unreacted low carbon austenite to form pearlite; and (d) cooling said heat treated iron to room temperature.

Advantageously, the austemper heat treatment comprises heating to the temperature level of 1550°–1625° F. and holding said temperature for 1½ to 4 hours, downquenching to the temperature range of 460°–800°

F., and holding for 0.5–4 hours. The heating to a pearlite forming temperature advantageously comprises upquenching to 1200°–1300° F. for a period of 2–5 minutes and air cooled to room temperature. The cast iron resulting from practicing the method herein will advantageously consist of a cast iron having a matrix of high carbon austenite and ferrite and 2–10% pearlite. The physical characteristics of such machinable iron will comprise a yield strength of at least 90 ksi, a tensile strength of at least 135 ksi, an elongation of at least 5%, and a hardness of no greater than 290 BHN. Machinability of such cast iron is characterized by being able to machine with no greater than 0.01 inch of machine tool wear when cutting at a speed of 500 sfm, depth of cut of 0.060 inch, and a feed rate of 0.01 inch per revolution for a period of 0.5 hours.

DETAILED DESCRIPTION AND BEST MODE

The method of this invention for making a high strength, readily machinable ductile or semiductile cast iron comprises essentially forming a ferrous alloy melt of a particular constituency, heat treating the solidification of said melt to an austempering treatment to be followed by a upquenching heat treatment. The solidified heat treated iron is then cooled to room temperature.

Melt

The melt for such method is characterized by special chemistry, and consists essentially of, by weight percent, a carbon equivalent (carbon plus one-third silicon) equal to 4.3–5.0, wherein the carbon is in the range of 3.0–4.0% and the silicon is the range of 2.0–3.0%, manganese in the range of 0.1–0.9%, up to 0.02% phosphorous, up to 0.002 sulphur, up to 1% contaminants or impurities, 0–0.4% molybdenum, 0–3.0% nickel or copper, and the remainder essentially iron.

The melt is subjected to a graphite modifying agent in an amount and for a period of time effective to form either ductile or semiductile iron upon solidification. The solidified melt will usually contain magnesium in the range of 0.03–0.06 weight percent if a ductile iron is desired, and magnesium in the range of 0.015–0.025 weight percent if a semiductile iron (compacted graphite) is desired.

By maintaining manganese at 0.3% or below, the manganese will not segregate significantly into the cell boundary during solidification of the melt and thus the manganese will not function as a precursor for retaining austenite. However, it is expensive to maintain Mn below 0.3%; in a normal melt, manganese would be about 0.7–0.08%. Nickel is present to function as an agent to increase hardenability of the matrix, i.e., to prevent pearlite formation during downquenching, and does not segregate out into the cell boundary.

If silicon were to exceed 3.0%, it would be disadvantageous because it causes incomplete austenitization and lowers impact strength; if silicon were to be present below 2.0%, it would be disadvantageous because of carbide formation. Manganese, if exceeding 0.9%, will result in increasing volume of massive carbides. Molybdenum functions here to increase hardenability, but over 0.5% it segregates and promotes carbide formation.

Since the goal of this invention is to minimize or eliminate the unreacted retained austenite, it is important to point out that the more carbon you have in the solidified melt during austenitization, the more sluggish the austempering reaction will be so that there will be increased amount of unreacted retained austenite. Accordingly, it is important that the carbon be conditioned in such a manner to be less soluble and this is brought about by decreasing the manganese content normally used with a austempered ductile or semiductile iron, which may be in the range of 0.55–1.0%.

Manganese increases carbon solubility and high carbon stabilizes the austenite and makes the austempering reaction sluggish. Manganese increases the volume of the unreacted retained austenite, but it is the goal of the process of this invention to compensate for high unreacted retained austenite. Contrarywise, silicon works the opposite. Increasing the amount of silicon will make the carbon less soluble in the austenite, thereby promoting the conversion of austenite to high carbon austenite and ferrite during the austempering treatment. Such silicon should be increased to the range of 2.5–3.0% rather than the general range of as low as 2%.

Austemper Heat Treatment

The solidified cast iron subjected to an austempering heat treatment which specifically comprises heating the solidified iron melt to an austenitizing temperature condition in the range of 1550°–1625° F. and holding said temperature for 1½ to 4 hours. The minimum time at such austenitizing temperature is suggested to be about 1½ hours to assure complete austenitization. The maximum austenitizing temperature time is suggested to be about four hours because of waste of time and energy.

The austenitized iron is then quenched at a rate of at least 550° F./min. to the temperature range of 460°–800° F., and it is held at this temperature level for about 0.5–4 hours. If held less than 0.5 hours, the following will result: incomplete reaction, presence of unreacted retained austenite which will transform to martensite on cooling to room temperature or stressing such as during machining. Martensite makes machining difficult, and impact and fatigue properties go down. If held longer than four hours, it will result in a bainitic matrix, which is ferritic and carbidic; this is brittle and ductility impact and fatigue properties are lower. The cast iron at this stage will contain acicular high carbon austenite and ferrite in the matrix and some cellular metastable retained austenite. The heat treated cast iron at this stage would normally have a hardness of 27–300 $R_c$. Martensite is present in the matrix because of the transformation of austenite to martensite.

The reason the austenitizing temperature is in a lower range of 1575°–1625° F. is because the lower the temperature the lower the solubility of carbon in the austenite, and this accelerates the austempering reaction when carbon is less soluble.

Upquench Heat Treatment

The austempered iron is then immediately and continuously heated to a pearlite forming temperature which comprises upquenching to at least the temperature range of 1200°–1300° F. for a period of 2–5 minutes (typically about three minutes) so that pearlite will result from the transformation of the retained austenite. The microstructure of the resulting iron will consist of a matrix comprised essentially of high carbon austenite, ferrite, and some pearlite in an amount of about 2–10% and little or no martensite present nor retained austenite. The upquenching and cooling treatment will result in the loss of about 5% of the strength and about 3% of the ductility that would be normally enjoyed as a result of austempering heat treatment, but such loss is offset by the tremendous increase in machinability of this iron.

This process accommodates manganese in increased amounts and manganese is inherent in the iron melt and in many types is required to be high for pearlitic irons. With typical manganese contents of 0.7–0.9%, the quantity of retained austenite that will be present in the solidified melt will be reduced from about 10% to about zero.

The more carbon that is in solution in the austenitized iron, the more retained austenite will be present. Accordingly, the temperature at which the iron is austenitized is reduced so as to reduce the amount of carbon that is in solution in the matrix which will be about 1.2%, whereas the remaining carbon will be in the form of graphite. When the austenitized iron is quenched to the temperature range of 460°–800° F., the metal will go through the bainite nose of a time, temperature, and transformation diagram, and the resultant iron will contain high carbon austenite and ferrite along with some (less than 10%) unreacted, unstable austenite.

Upon upquenching to the temperature level of 1200°–1300° F., the unreacted, unstable austenite is converted to pearlite and will accompany the existing high carbon, austenite and ferrite. Upon cooling to room temperature, the resultant iron will have a strength level of about 109,000 psi, a tensile strength of about 140,000 psi, and an elongation of about 4–5%.

The pearlite will occupy about 2–10% of the resultant iron. This compares favorably with an austempered ductile or semiductile iron which contains either unreacted retained austenite or martensite. Martensite is detrimental to machining operations because anything more than 2% martensite is enough to create serious wear problems in the tooling.

In order to illustrate more clearly the criticality of the chemistry and processing of this invention, several samples were prepared and processed with certain variables in the chemistry and certain variables in the processing, thereby corroborating the invention herein (see Table I). Each of the samples had a carbon equivalent of about 4.5 with the carbon being about 3.6%. The sulphur and phosphorous contents were in the ranges required. The iron was treated with magnesium to obtain a ductile iron. The elements of manganese, nickel and silicon were then adjusted, as indicated in column 2 of the Table. In some examples the austenitizing temperature was varied, and in other cases the down quench temperature was varied, and in some cases the upquench temperature was varied. The resultant irons were evaluated as to retained austenite, machinability, strength, hardness and ductility.

You will note that when the manganese content was too low, the following result occurred: the matrix was uniform and no unreacted austenite was present. When the manganese content was excessive, the iron possessed a lot of unwanted and unreacted retained austenite. When nickel was added along with low levels of manganese, the iron exhibited a desirable matrix. When silicon was in excess of that required, it caused austenitization to be incomplete and silico-ferrite was present in the matrix. When the austenitizing temperature was in excess of that required herein, it caused excessive pearlite to be present. Excessive unreacted retained austenite will also be present due to higher carbon content, but this process cures the excessive retained austenite problem. When the downquench temperature was too low, martensite formed instead of the desirable high carbon austenite and ferrite. When the downquench temperature was too high, the austempering reaction was incomplete. When the upquench temperature was too high, cementite formed in the austempered structure and the impact and fatigue properties dropped severely. When the upquench temperature was too low, the pearlite transformation did not take place.

The manner in which machinability was evaluated was according to the following procedure: samples were drilled and the tool wear was observed by measuring diameters before and after.

This is not to say that ductile irons have not been made heretofore that have consisted of pearlitic-bullseye ferrite irons (80–20% respectively). However, such irons possessed a yield strength of only about 65 psi, tensile strength of about 80 psi, and elongation of only 2–3%. Such irons were premachined before austempering heat treatment which required them to be taken off line and created a very expensive processing sequence. With the present process, a partially pearlitic austempered cast iron can be created which has highly enhanced yield and tensile strengths along with increased elongation and which can be machined after heat treatment thus eliminating the necessity to have it taken off line.

While preferred embodiments of the invention have been illustrated and described, it will be obvious to those skilled in the art that various changes and modifications may be made without departing from the invention, and it is intended to cover in the appended claims all such modifications and equivalents as fall within the true spirit and scope of the invention.

TABLE I

| | Processing | | | | Final Product | | | | | |
|---|---|---|---|---|---|---|---|---|---|---|
| | | | | | | | Strength | | | |
| Sample | Mn/Ni/Si Additive | Austenitizing Temperature °F. | Downquench Temperature °F. | Upquench Temperature °F. | Matrix Constituent Other Than High Carbon Austenite and Ferrite | Machinability | Yield ksi | Tensile ksi | Hardeness | Elongation |
| 1 | .4/0/2.7 | 1600 | 650 | 1250 | 2% Pearlite No Retained Austenite | Excellent | 108 | 152 | 300 | 6% |
| 2 | .1/2/2.0 | " | " | " | 0% Pearlite No Retained Austenite | Good | 110 | 158 | 290 | 8% |
| 3 | 1.0/0/1.9 | " | " | " | Massive Carbides Retained Austenite and Martensite | Poor | 100 | 130 | " | 2% (Brittle) |
| 4 | .4/0/2.7 | " | 400 | " | Austenite and Ferrite Martensite | " | 110 | 134 | " | 1% |
| 5 | .4/9/2.7 | 1800 | 650 | " | 14% Pearlite No Retained | " | 90 | 145 | " | 4% |

TABLE I-continued

| | Processing | | | | Final Product | | | | | |
|---|---|---|---|---|---|---|---|---|---|---|
| Sample | Mn/Ni/Si Additive | Austenitizing Temperature °F. | Downquench Temperature °F. | Upquench Temperature °F. | Matrix Constituent Other Than High Carbon Austenite and Ferrite | Machinability | Strength Yield ksi | Strength Tensile ksi | Hardeness | Elongation |
| 6 | .4/0/2.7 | 1600 | " | 1350 | Austenite High Carbon Austenite and Fe, Cementite | " | 85 | 140 | 293 | 3% |
| 7 | .4/0/2.7 | " | " | 1000 | No Pearlite | " | 83 | " | 292 | 5% |

I claim:

1. A method of making a high strength, readily machinable ductile or semiductile cast iron, comprising: (a) forming a ferrous alloy melt consisting essentially of, by weight, 3–4% carbon, 2.0–3.0% silicon, 0.9% manganese, up to 0.02% phosphorous, up to 0.002% sulphur, up to 1% contaminants or impurities, 0–0.4% molybdenum, 0–3.0% nickel or copper, and the remainder essentially iron, said melt being subjected to a graphite modifying agent in an amount and for a period of time effective to form either ductile or semiductile iron upon solidification;

(b) heat treating the solidification of said melt by austempering to form a matrix consisting substantially of high carbon austenite, ferrite, and a cell boundary having unreacted low carbon austenite;

(c) heating said austempered iron to a pearlite forming temperature and holding at said temperature to permit the unreacted low carbon austenite to form pearlite; and (d) cooling said heat treated iron to room temperature.

2. The method as in claim 1, in which step (b) comprises heating to the temperature level of 1550°–1625° F. and holding said temperature for a period of time of 1.5 to 4 hours, downquenching to the temperature range of 460°–800° F. and holding at said latter temperature for 0.5 to 4 hours.

3. The method as in claim 2, in which said downquenching is at a rate of at least 550° F./minute.

4. The method as in claim 1, in which step (c) comprises heating to a temperature level of 1200°–1300° F. for a period of 3–5 minutes.

5. A cast iron made by the process of claim 1, the cast iron being characterized by a matrix of high carbon austenite and ferrite and 2–10% by volume pearlite and is subtantially devoid of unreacted low carbon retained austenite.

6. The cast iron as in claim 5, in which said iron has a yield strength of at least 90,000 psi, a tensile strength of at least 135 psi, an elongation of at least 5%, and a hardness of no greater than 290 BHN.

7. The cast iron as in claim 5, which has a machinability characteristic such that it can be machined with no greater than 0.001 inches of wear when cutting at a speed of 500 sfm, depth of cut of 0.06 inch, and a feed rate of 0.01 inch per revolution for a period of 0.5 hours.

* * * * *